United States Patent [19]

Wilder

[11] 4,326,586

[45] Apr. 27, 1982

[54] METHOD FOR STRESSING THERMAL WELL CASINGS

[75] Inventor: Lawrence B. Wilder, Tulsa, Okla.

[73] Assignee: Standard Oil Company (Indiana), Chicago, Ill.

[21] Appl. No.: 165,522

[22] Filed: Jul. 3, 1980

[51] Int. Cl.[3] ..... E21B 33/14; E21B 33/16

[52] U.S. Cl. ..... 166/285; 166/291; 405/154

[58] Field of Search ..... 166/285, 286, 290, 242

[56] References Cited

U.S. PATENT DOCUMENTS

| | | | |
|---|---|---|---|
| 2,738,011 | 3/1956 | Mabry | 166/290 X |
| 2,876,844 | 3/1959 | Warner | 166/290 X |
| 3,055,424 | 9/1962 | Allen | 166/285 |
| 3,557,875 | 1/1971 | Solum et al. | 166/286 |
| 3,667,547 | 6/1972 | Ahlstone | 166/286 |
| 3,976,139 | 8/1976 | Wilder | 166/285 |
| 4,155,404 | 5/1979 | Hollingsworth | 166/285 |

*Primary Examiner*—Stephen J. Novosad
*Assistant Examiner*—George A. Suchfield
*Attorney, Agent, or Firm*—Scott H. Brown; Fred E. Hook

[57] ABSTRACT

This invention relates to an improved method of cementing a casing string in a wellbore where the casing string will subsequently be heated by the injection of steam or by flowing of other hot fluids through the casing. The annulus between the wellbore and casing is at least partially filled with cement. A J-slot is positioned on the lower portion of the casing string. The lower end of a tubing string is provided with a stressing tool and lug, the lug being engageable with the J-slot and the tubing string is lowered into the casing and the lug is engaged with the J-slot. The tubing string is stressed until the cement in the annulus sets, thereby allowing the casing to be set under stress.

3 Claims, 4 Drawing Figures

METHOD FOR STRESSING THERMAL WELL CASINGS

BACKGROUND OF THE INVENTION

1. Field of the Invention

This invention relates to a method and apparatus of cementing a casing in a wellbore in which the casing will subsequently be heated to a higher temperature, causing it to want to elongate. In particular, it concerns a method whereby the cement is circulated using conventional methods, the casing is stressed and the cement is allowed to set.

2. Setting of the Invention

In the search for oil and gas, boreholes are drilled deep into the earth. These holes are lined with casing, which is usually heavy steel pipe, and cement is forced into the annulus between the casing and the borehole wall. In most cases, the temperature of the fluid if flowing through the casing is such that the temperature of the casing does not vary to any degree from that at which it was set. However, in a growing number of situations, the fluid flowing through the wellbore is of such high temperatures that the casing is heated to a much higher temperature then when the casing was set. This is true of thermal wells. A thermal well can be a well in which steam or other hot fluids are injected down through a tubing string suspended in the wellbore to aid in the recovery of the fluid from the underground formation, or which the produced fluid from a formation are at a very high temperature. The increased temperature in a thermal well causes the casing to try to elongate. It has been found that if the casing is hung and cemented and large temperature differences are added to the casing, the tensile stress reduction for the fixed cmemented casing is approximately 200 psi per degree F change.

In conventionally cementing a casing string in a wellbore, the casing string is reciprocated and rotate during the placing or circulation of the cement between the outer wall of the casing and the wellbore.

3. Relevant Publications

U.S. Pat. No. 3,976,139, Lawrence B. Wilder, issued Aug. 24, 1976 and entitled "Anchoring for Tensing Casing and Thermal Wells" concerns a method for pretensioning a casing string and cementing it in place while this tension condition is maintained. The method of Wilder requires that the casing string be anchored to the formation wellbore wall after the cement has been circulated. Such an arrangement does not permit the casing to be placed under stress and rotated in the same operation. Further, the method does not allow the casing string to be put under stress during the circulation of the cement. Still further, the method does not allow the casing string to be rotated while being maintained under stress.

The instant invention described herein has a different anchoring system and permits cement to be placed in the casing annulus in the conventional manner while stressing is placed upon the casing string.

BRIEF SUMMARY OF THE INVENTION

By this invention, a method is disclosed for stressing a casing while cementing the casing in a wellbore including the steps of suspending the casing in the wellbore, placing cement in at least a portion of the annulus between the casing and the wall of the wellbore, tensioning the casing while the cement is allowed to set.

BRIEF DESCRIPTIONS OF THE DRAWINGS

A better understanding of the invention and various modifications of objects thereof can be made from the following description taken in conjunction with the drawing in which FIGS. 1 to 4 in large cut away views, mostly in section show one embodiment of the stressing device of the invention.

DETAILED DESCRIPTION OF THE INVENTION

Figure 1:
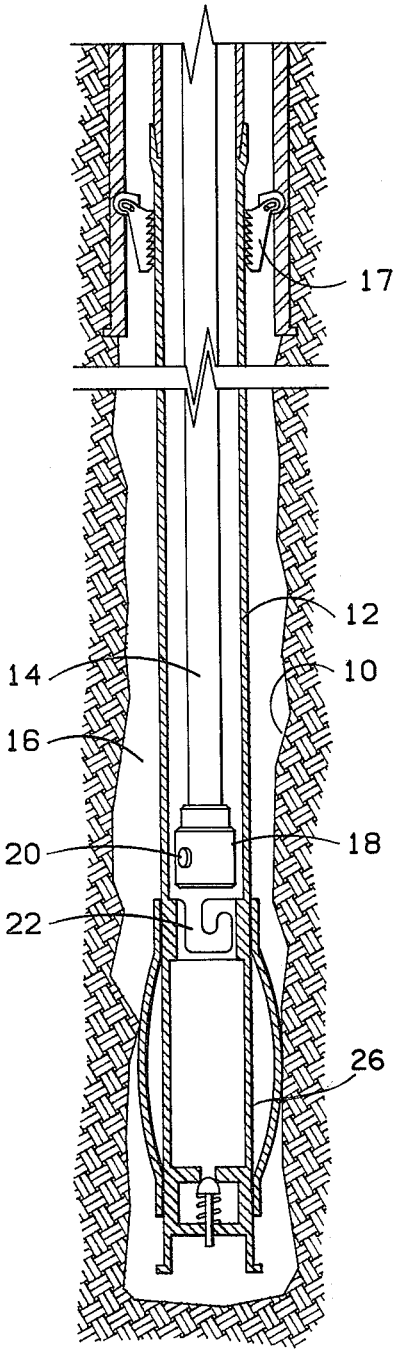
Figure 2:
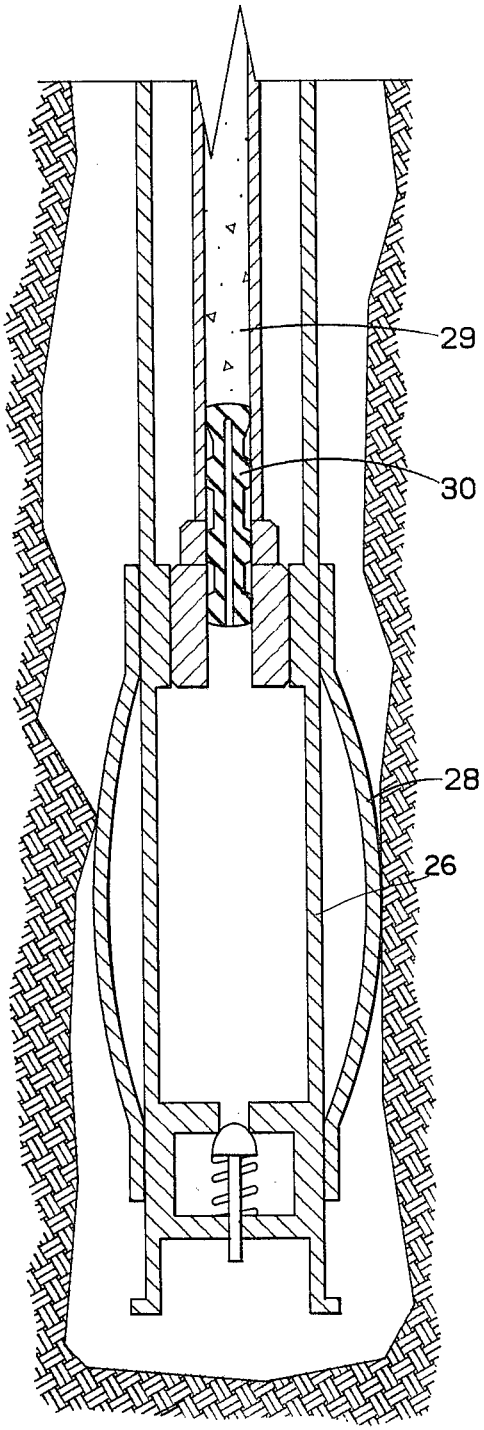
Figure 3:
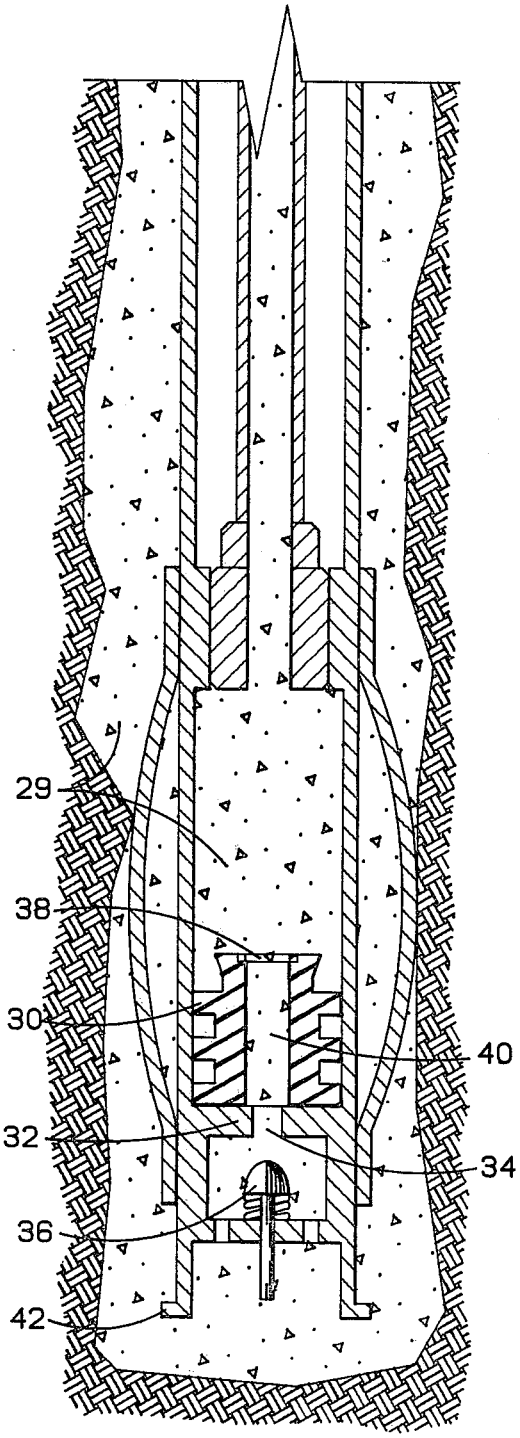
Figure 4:
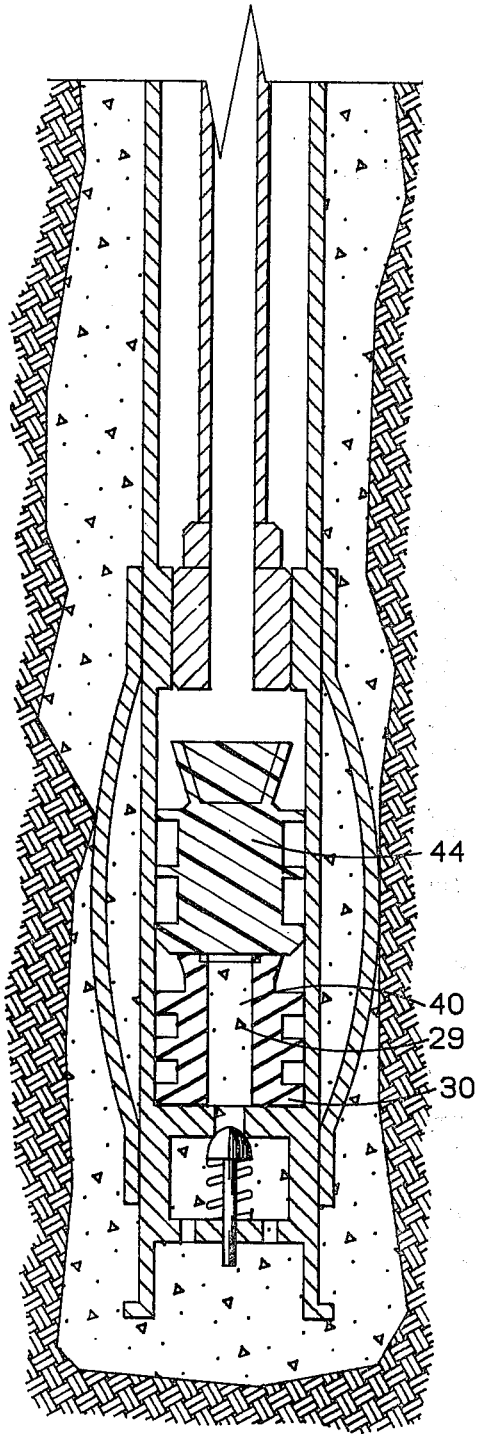

With reference now to FIG. 1 in preparation for production of oil or gas from the subterranean formation, a borehole 10 is drilled into the formation, a casing 12 is lowered into the borehole 0 to its desired position, and a tubing string 14 is lowered into the casing 12. Between the casing 12 and the borehole 10 is an annular space 16 which is to be filled with cement. Preferably, the casing 12 is maintained in an essentially stationally fixed position during the method of this invention by slips 17.

The lower end of the tubing string 14 is provided with a stressing tool 18 which has a stressing lug 20. The lower portion of the interior wall of the casing string 12 is provided with a J-slot 22 which is engageable with tool 18 and lug 20 of the tubing string 14. The tubing string 14 with tool 18 is then positioned by a surface operator to engaged the J-slot 22 of casing 12 and the lug 20 and J-slot 22 are engaged.

A cement slurry 29 is then pumped down the interior of tubing 14 into the casing 12, past the bottom end 26 of the casing 12 and up the annulus 16.

The pressure on the cement is then sufficiently increased to rupture rubber diaphragm 38 at the top of bottom plug 30 and this allows the cement slurry 29 to proceed down through passage 40 of the plug 30 through float collar 32 and past the bottom end 42 of the casing 12 and up the annular space 16.

After the annulus 16 has been filled to a sufficient level with the cement slurry 29 and before the cement slurry sets the tubing string 14 is stressed at the surface, thus causing the lower portion of casing 12 to be stressed. The casing 12 may be compressed or tensioned, depending upon the position of J-slot 22 used on the casing 12. This stressing procedure continues until the cement has set in the annular space 16. Preferably, a drilling string is used as the tubing string 14.

J-slot 22 and stressing tool 18 and lug 20 can be made of high strength alloy steel so that collectively they can have a stress strength that is equal to or greater than the stress strength of the casing 12 or the tubing string 14.

While the above invention is described in detail, various modifications can be made there from without departing from the spirit or scope of the invention.

We claim:

1. A method for stressing a string of casing suspended in a borehole drilled in the earth wherein fluids will flow at a temperature greater than the initial temperature at which said casing is cemented comprising:

a. suspending said casing in said wellbore, b. suspending a string of tubing in said casing, c. attaching the lower end of said tubing to the lower portion of said casing, d. circulating cement into at least a portion of the annulus between said casing and the wall of said wellbore, e. stressing said tubing thereafter but before said cement has set, f. maintaining said stress on said tubing until said cement has set, thereby setting said casing in a stressed condition.

2. The method of claim 1 wherein said cement is circulated down the interior of said tubing into said annulus.

3. The method of claim 1 additionally comprises maintaining the upper portion of said casing in an essentially fixed position.

* * * * *